US009968954B2

(12) United States Patent
Becker et al.

(10) Patent No.: US 9,968,954 B2
(45) Date of Patent: May 15, 2018

(54) SPRAYER WITH INTEGRATED VALVE SEATS

(71) Applicant: Graco Minnesota Inc., Minneapolis, MN (US)

(72) Inventors: Steven D. Becker, Blaine, MN (US); Craig J. Wojciechowski, Foley, MN (US); Harold D. Johnson, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days. days.

(21) Appl. No.: 15/111,412

(22) PCT Filed: Jan. 20, 2015

(86) PCT No.: PCT/US2015/012026
§ 371 (c)(1),
(2) Date: Jul. 13, 2016

(87) PCT Pub. No.: WO2015/109310
PCT Pub. Date: Jul. 23, 2015

(65) Prior Publication Data

US 2016/0339462 A1 Nov. 24, 2016

Related U.S. Application Data

(60) Provisional application No. 61/929,385, filed on Jan. 20, 2014.

(51) Int. Cl.
*B05B 17/00* (2006.01)
*B05B 9/04* (2006.01)
(Continued)

(52) U.S. Cl.
CPC ..... *B05B 9/0426* (2013.01); *B05B 1/12* (2013.01); *B05B 1/3006* (2013.01);
(Continued)

(58) Field of Classification Search
CPC ..... B05B 9/0426; B05B 1/12; B05B 1/3006; B05B 1/3013; B05B 1/3046; B05B 9/01; B05B 9/0861
(Continued)

(56) References Cited

U.S. PATENT DOCUMENTS 6,626,380 B1 * 9/2003 Williams ..... B05B 9/0861 239/332
7,303,149 B1 * 12/2007 Huang ..... B05B 7/0815 239/302
(Continued)

FOREIGN PATENT DOCUMENTS

CN 101797412 A 8/2010
JP 2013057311 A1 3/2013
WO WO2007/138084 A2 12/2007

OTHER PUBLICATIONS

International Search Report and Written Opinion from PCT Application Serial No. PCT/US2015/012026, dated Apr. 29, 2015, 12 pages.
(Continued)

*Primary Examiner* — Steven J Ganey
(74) *Attorney, Agent, or Firm* — Kinney & Lange, P.A.

(57) ABSTRACT

A fluid sprayer comprises a fluid source, a spray tip, a pump, and an outlet check value assembly. The spray tip has a fluid outlet aperture, and the pump is disposed to pump fluid from the fluid source out the fluid outlet aperture. The outlet check valve is disposed between the pump and the spray tip, and includes a sealing element, a seat, and a polymer housing. The seat is aligned to receive the sealing element, and the polymer housing is overmolded about the seat.

16 Claims, 4 Drawing Sheets

(51) Int. Cl.

| | |
|---|---|
| ***B05B 1/12*** | (2006.01) |
| ***B05B 9/01*** | (2006.01) |
| ***B05B 9/08*** | (2006.01) |
| ***B05B 1/30*** | (2006.01) |

(52) U.S. Cl.
CPC ..... *B05B 1/3013* (2013.01); *B05B 1/3046* (2013.01); *B05B 9/01* (2013.01); *B05B 9/0861* (2013.01)

(58) Field of Classification Search
USPC ..... 239/302, 332, 340, 346, 569
See application file for complete search history.

(56) References Cited

U.S. PATENT DOCUMENTS

| | | | | |
|---|---|---|---|---|
| 2003/0201339 | A1 | 10/2003 | Foster et al. | |
| 2007/0045447 | A1 | 3/2007 | Wipper | |
| 2007/0278787 | A1 | 12/2007 | Jones et al. | |
| 2008/0272155 | A1 | 11/2008 | Neuhaus et al. | |
| 2010/0006671 | A1* | 1/2010 | Seabase ..... | B05B 7/0815 239/332 |

OTHER PUBLICATIONS

Office Action from Chinese Patent Application No. 2015800032594, dated Dec. 14, 2017, 12 pages.

* cited by examiner

SPRAYER WITH INTEGRATED VALVE SEATS

BACKGROUND

The present invention relates generally to fluid spraying systems. More particularly, the invention relates to overmolded seat housings for valve seats in a fluid sprayer.

Fluid spraying systems are commonly used in a wide variety of applications, from industrial assembly to home painting. Handheld sprayers can be used by a human operator, while automated sprayers are typically used in mechanized manufacturing processes. Sprayers commonly have at least one check valve situated at or near a spray outlet. This valve is biased closed to prevent leakage when fluid is not being sprayed. Outlet valves and other valves within fluid spraying systems include valve seats that receive sealing elements such as balls (in the case of ball valves) or pins (in the case of pin valves). These valve seats are ordinarily inserted and affixed into rigid valve housings using adhesive. Slight misalignements of valve seats within valve assemblies can easily occur, forcing sealing elements to translate laterally to align with valve seats. This translation increases the axial force required to align sealing elements with seats, altering the pressure at which valves open.

SUMMARY

In a first embodiment, a fluid sprayer comprises a fluid source, a spray tip, a pump, and an outlet check valve assembly. The spray tip has a fluid outlet aperture, and the pump is disposed to pump fluid from the fluid source out the fluid outlet aperture. The outlet check valve is disposed between the pump and the spray tip, and includes a sealing element, a seat, and a polymer housing. The seat is aligned to receive the sealing element, and the polymer housing is overmolded about the seat.

In a second embodiment, a method of forming a check valve assembly for a fluid sprayer comprises fabricating a valve seat, clamping the valve seat between a front pin and a rear pin, assembling a mold about the clamped valve seat, injection-molding a seat housing about the clamped valve seat, and removing the clamps and mold from the housing.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale.

DETAILED DESCRIPTION

The present invention relates to a fluid sprayer such as a hand-held paint spraying system. The sprayer has a prime valve for priming fluid for pumping, and an outlet check valve for restricting fluid flow through an outlet aperture of a spray tip. The outlet check valve and the prime valve each include sealing elements that rest on rigid valve seats situated within overmolded polymer housings. The overmolding of these housings allows valve seats to be very precisely aligned and assembled without need for adhesive.

Figure 1:
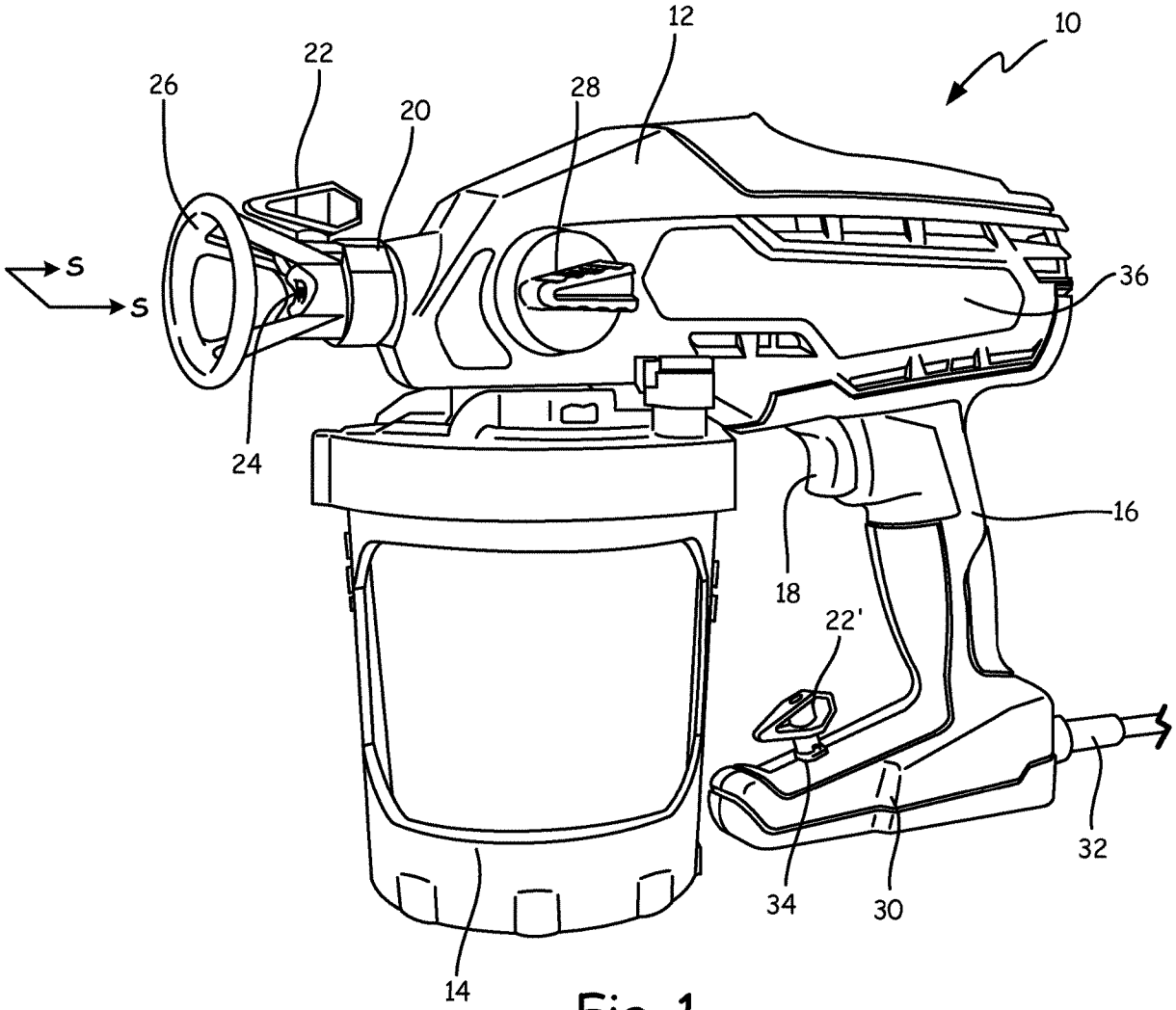
FIG. 1 is a perspective view of a fluid sprayer.

FIG. 1 is a perspective view of sprayer 10, a handheld fluid sprayer according to one embodiment of the present invention. Sprayer 10 includes body 12, source 14, grip 16, trigger 18, nozzle 20, spray tips 22 (with outlet aperture 24) and 22', guard 26, prime valve assembly 28, base 30, power cord 32, storage slot 34, and pump 36. In the depicted embodiment, sprayer 10 can, for example, be an electrical spray device for use with paint, solvent, or other fluids. Although sprayer 10 is illustrated as a hand-held device, stationary or machine-driven sprayers can also utilize the spray tip of the present invention.

Body 12 of sprayer 10 includes pumping elements suitable to drive fluid from source 14 towards nozzle 20, and expel fluid from outlet aperture 24 of spray tip 22. In the depicted embodiment, body 12 houses pump 36. Pump 36 can, for example, be an electric motorized pumps that receives power through power cord 32, or from an integral battery pack (not shown). Grip 16 provides a hand-hold for a human user. When the user depresses trigger 18, sprayer 10 draws fluid from source 14 through body 12, and expels this fluid through nozzle 20. Trigger 18 can, for example, actuate pump 36. Pump 36 may, for example, be a high-pressure pump capable of operating at peak pressures in excess of 360 psi. In one embodiment, sprayer 10 is rated for pressures of up to 2000 psi, and has average operating pressures of approximately 1000 psi, with peak operating pressures of approximately 1500 psi. Although source 14 is depicted as a substantially cylindrical fluid receptacle carried by body 12, alternative embodiments of source 14 can include receptacles of other shapes and sizes, as well as fluid lines or hoses connectable to external fluid supplies. Source 14 can, for example, be a disposable paint container such as a deflating bag. Prime valve assembly 28 can be used to prime pumping elements within body 12 prior to spraying fluid from source 14.

Nozzle 20 houses spray tip 22. Spray tip 22 can, for example, be a removable element with a substantially cylindrical portion insertable into nozzle 20 to provide a desired spray pattern, as depicted and described in further detail below with respect to FIG. 2. Spray tip 22 includes outlet aperture 24, a ground or otherwise machined narrow aperture that atomizes spray fluid and defines a spray pattern. Sprayer 10 can accept various spray tips 22, e.g. spray tips 22 and 22' with different outlet apertures 24 capable of producing different spray patterns suitable for different applications. For example, a spray tip 22 that produces a wide spray pattern can be swapped out for a spray tip 22' that produces a narrow spray pattern when precision spraying is required. In the depicted embodiment, base 30 provides attachment point for power cord 32, and houses storage slot 34 for one such reserve or alternate spray tip 22'. Nozzle 20 is protected by guard 26, a rigid or semi-rigid positioning element. In the depicted embodiment, guard 26 is an elliptical frame situated forward of spray tip 22.

Figure 2:
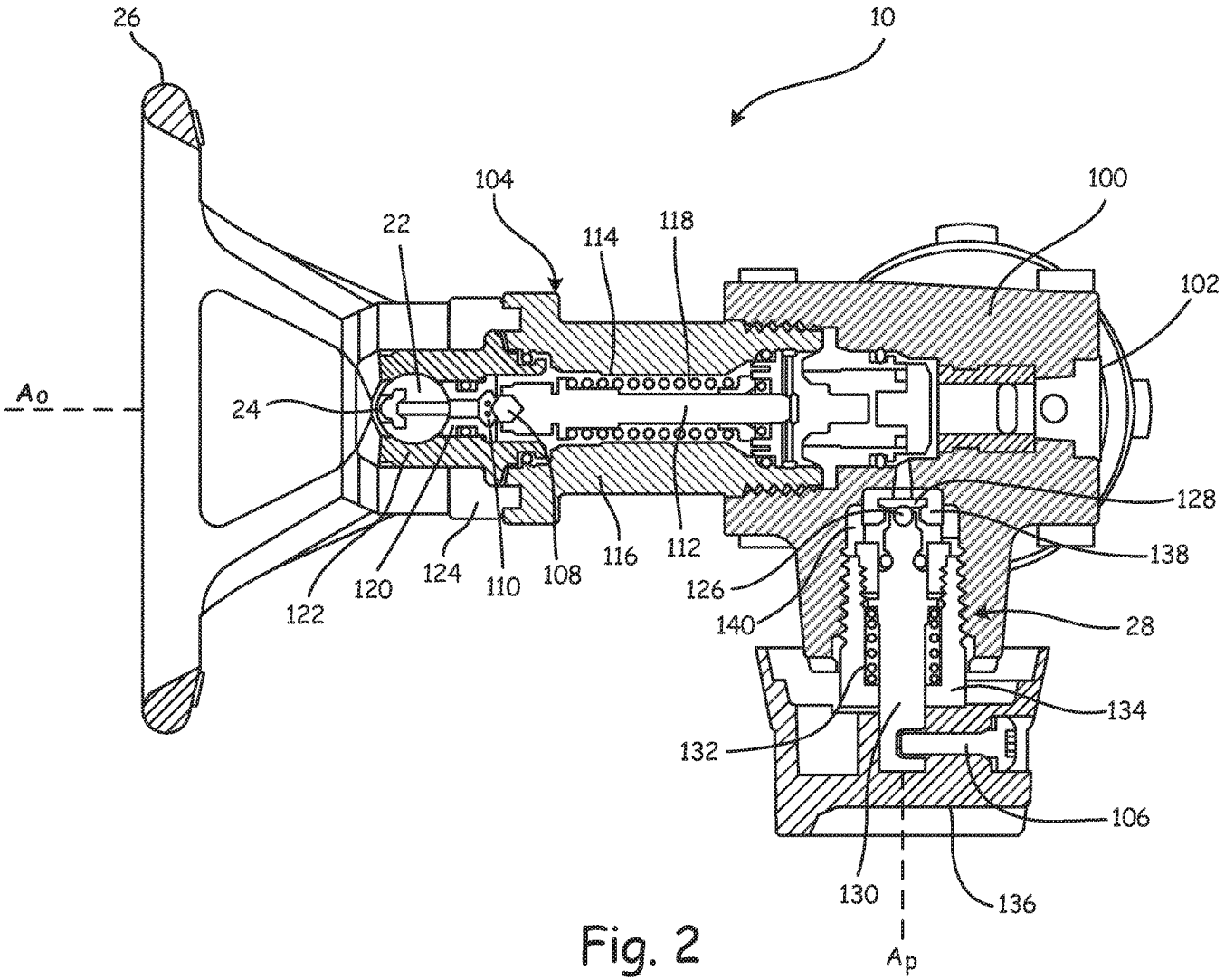
FIG. 2 is a cross-sectional view of the fluid sprayer of FIG. 1, illustrating valve assemblies and fluid passages of the sprayer.

FIG. 2 is a cross-sectional view of a portion of sprayer 10 through section line S-S of FIG. 1. FIG. 2 depicts spray tip 22, outlet aperture 24, guard 26, prime valve assembly 28, main pump housing 100, main pump chamber 102, and outlet check valve assembly 104, and prime pin 106. Outlet check valve assembly 104 includes outlet check valve sealing element 108, outlet check valve seat 110, outlet check valve rod 112, outlet check valve bias element 114, main outlet check valve housing 116 (which defines outlet check valve chamber 118), outlet check valve seat housing 120, tip housing 122, and nut 124. Prime valve assembly 28 includes prime valve sealing element 126, prime valve seat 128, prime valve rod 130, prime valve bias element 132, prime valve rod housing 134, prime valve cap 136, and prime valve seat housing 138 (which defines prime valve chamber 140).

Main pump chamber 102 interfaces with pump 36 (not shown; see FIG. 1) to draw fluid from source 14 into main pump chamber 102, and propel fluid out outlet aperture 24 of spray tip 22. Prime valve assembly 28 can be opened by removing prime pin 106 (situated in prime valve cap 136), thereby drawing fluid up from source 14 into main pump chamber 102 and allowing normal pumping of fluid through outlet aperture 24 to commence. Outlet check valve assembly 104 and prime valve assembly 28 are pressure-actuated check valve assemblies that open in response to high internal fluid pressure within sprayer 10. Prime valve assembly 28 opens only when prime pin 106 is disengaged from prime valve rod 130. Outlet check valve assembly 104 prevents leaking or dripping of fluid through outlet aperture 24 of spray tip 22. To this end, outlet check valve sealing element 108 of outlet check valve assembly 104 is situated close to spray tip 22, so that the fluid volume between outlet aperture 24 and outlet check valve sealing element 108 is low.

During ordinary operation, outlet check valve sealing element 108 and prime valve sealing element 126 are retained against outlet check valve seat 110 and prime valve seat 128, respectively, by outlet check valve rod 112 and prime valve rod 130. Outlet check valve rod 112 and prime valve rod 130 are in turn biased to "closed" positions by outlet check valve bias element 114 and prime valve bias element 132, respectively. In the illustrated embodiment, prime and outlet check valve bias elements 132 and 114 are springs disposed coaxially with prime valve rod 130 and outlet check valve rod 112, respectively. Outlet check valve sealing element 110 and prime valve sealing element 126 can, for example, be valve balls, as shown. In alternative embodiments, outlet check valve sealing element 108 and prime valve sealing element 126 can, for example, be pins or other shapes that mate with corresponding faces on outlet check valve seat 110 and prime valve seat 128, respectively (see FIG. 3, discussed below). Outlet check valve rod 112 reciprocates along an axis $A_O$ within outlet check valve housing 116, which defines outlet check valve chamber 118. Fluid pressure within check valve chamber 118 above a threshold actuation value $P_{actO}$ overcomes a substantially constant closing force exerted by outlet check valve bias element 114, causing outlet check valve sealing element 108 to recede from outlet check valve seat 110, opening outlet check valve assembly 104. Prime valve assembly 28 operates analogously while prime valve pin 106 is disengaged: prime valve rod 130 reciprocates along axis $A_P$, allowing prime valve sealing element 126 to separate from prime valve seat 128.

Outlet check valve seat 110 and prime valve seat 128 are rigid, durable elements with geometries suited to receive sealing elements 108 and 126, respectively, in tight seals. In one embodiment, outlet check valve seat 110 and prime valve seat 128 are formed of tungsten carbide blanks ground or otherwise machined to mate smoothly with sealing elements 108 and 126, respectively.

Outlet check valve seat 110 is situated within outlet check valve seat housing 120, a polymer element overmolded about outlet check valve seat 110 as described below with respect to FIGS. 3 and 4. Outlet check valve seat housing 120 can, for example, be formed of acetal or nylon. In the depicted embodiment, outlet check valve seat housing 120 is in turn situated within tip housing 122, which is secured to main outlet check valve housing 116 by nut 124. Nut 124 and/or tip housing 122 can, for example, be formed of cast aluminum. Prime valve seat 128 is similarly situated within prime valve seat housing 138, a polymer element overmolded about prime valve seat 128. In the depicted embodiment, prime valve seat housing 138 is threaded into prime valve rod housing, which surrounds prime valve rod 130 and retains prime valve bias element 132.

Outlet check valve seat housing 120 and prime valve seat housing 138 retain outlet check valve seat 110 and prime valve seat 128, respectively, without the need for adhesive. Furthermore, the overmolded design of outlet check valve assembly 104 and prime valve assembly 28 aligns outlet check valve seat 110 and prime valve seat 128 more precisely with axes $A_O$ and $A_P$, respectively. This precise alignment reduces the degree of lateral movement required to align outlet check valve sealing element 108 and prime valve sealing element 126 with their respective seats, reducing variation in opening pressures of outlet check valve assembly 104 and prime valve assembly 28 due to misalignment. The overmolded design of outlet check valve assembly 104 and prime valve assembly 28 thus allows sprayer 10 to actuate at precisely set pressures (i.e. precisely at $P_{actO}$).

Figure 3:
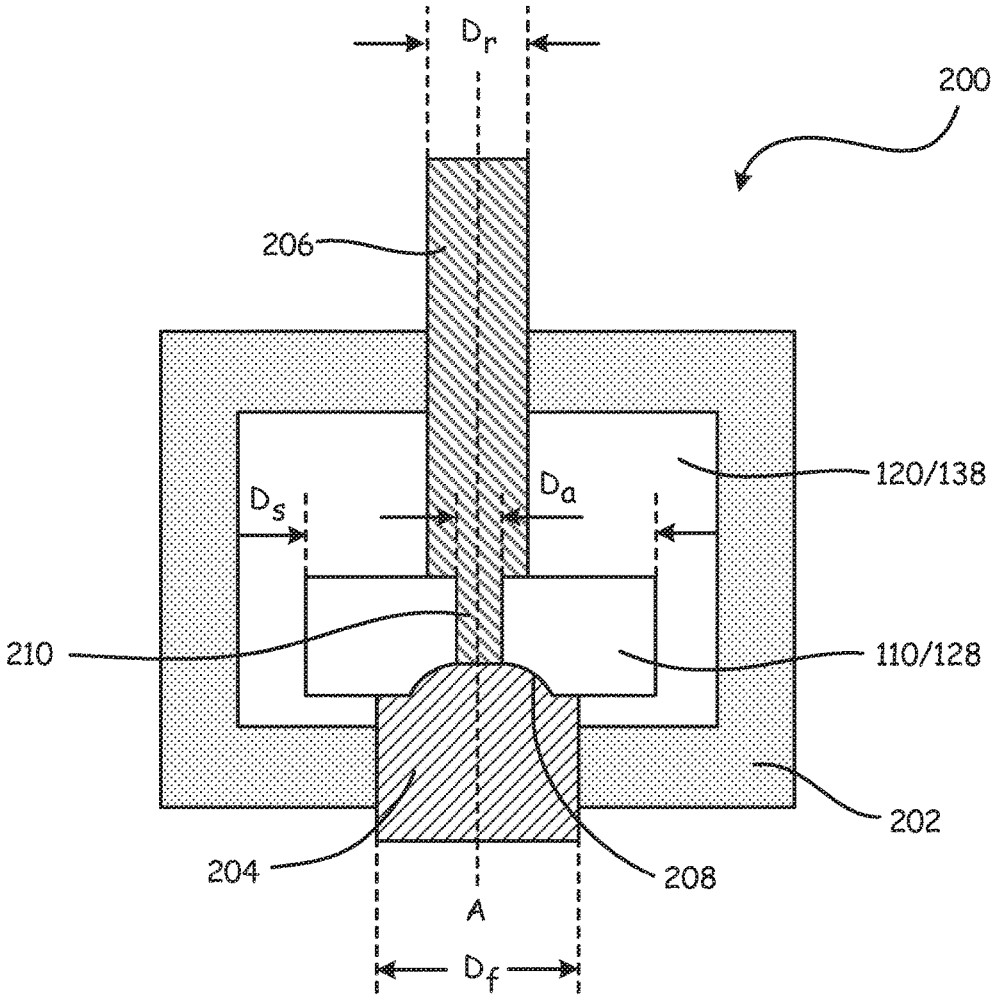
FIG. 3 is a simplified cross-sectional view of an assembly structure for the valve assemblies of FIG. 2.
Figure 4:
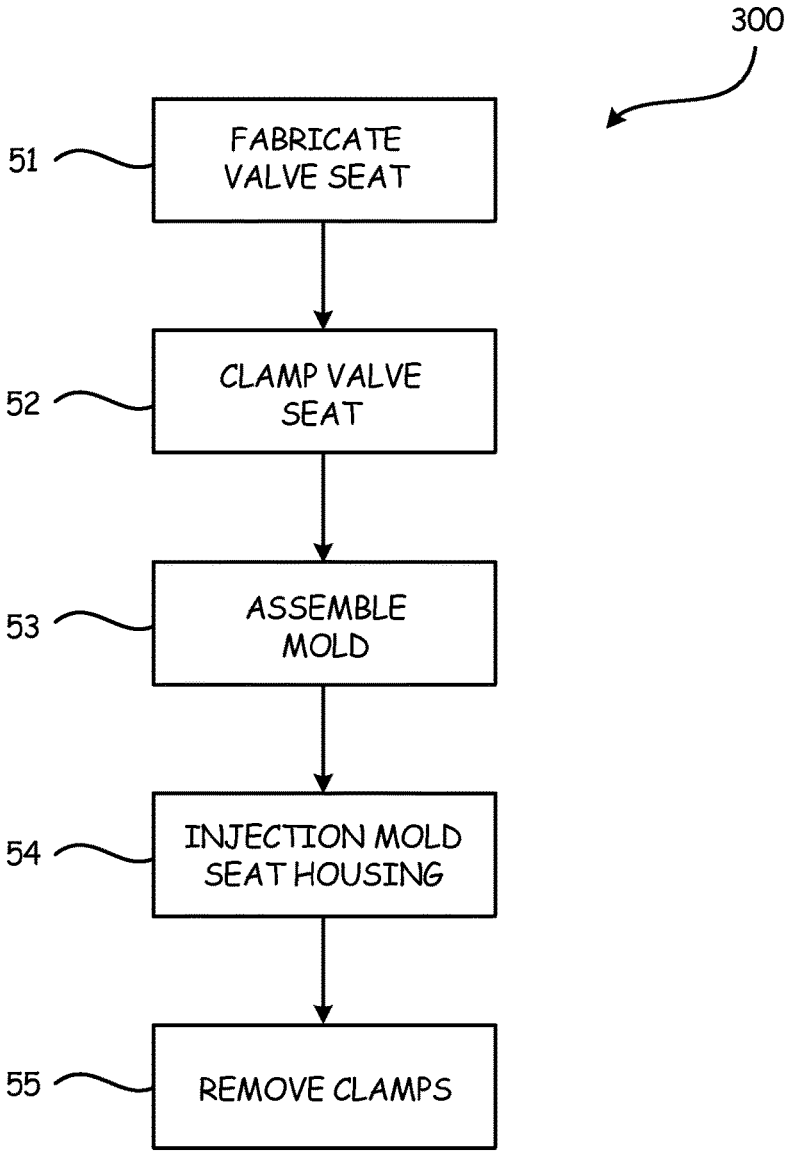
FIG. 4 is a flowchart illustrating a method of assembling the valve assemblies of FIG. 2 using the assembly structure of FIG. 3.

FIG. 3 is a simplified schematic view of assembly structure 200 for the fabrication of outlet check valve seat housing 120 or prime valve seat housing 138, and FIG. 4 is a flowchart illustrating method 300, a method of fabricating outlet check valve seat housing 120 and/or prime valve seat housing 138 using assembly structure 200. FIG. 3 illustrates outlet check valve seat 110 or prime valve seat 128, outlet check valve seat housing 120 or prime valve seat housing 138, mold 202, front pin 204, rear pin 206, seat face 208, seat aperture 210, front pin diameter $D_f$, rear pin diameter $D_r$, aperture diameter $D_a$, and seat diameter $D_s$.

Before outlet valve seat housing 120 or prime valve seat housing 138 can be assembled, outlet valve seat 110 and/or prime valve seat 128 are fabricated, e.g. by grinding or otherwise machining a tungsten carbide blank to have seat aperture 206 and seat face 208. (Step 51). Outlet valve seat 110 and/or prime valve seat 128 have seat diameter $D_s$. Seat aperture 206 extends along axis A (corresponding to axis $A_O$ of outlet check valve assembly 104, or axis $A_P$ of prime check valve assembly 28) entirely through outlet check valve seat 110 or prime valve seat 128, and serves as a fluid channel (with diameter $D_a$) through outlet check valve seat 110 and/or prime valve seat 128. Seat face 208 is contoured to mate smoothly with corresponding outlet check valve sealing element 108 or prime valve sealing element 126.

As noted above with respect to FIG. 2, outlet check valve seat housing 120 is overmolded about outlet check valve seat 110, and prime valve seat housing 138 is overmolded about prime valve seat 128. This is accomplished by clamping outlet check valve seat 110 or prime valve seat 128 between front pin 204 and rear pin 206. (Step 52). Front pin 204 and rear pin 206 have geometries matching corresponding faces of outlet check valve seat 110 or prime valve seat 128, with front pin 204 in particular fitting seal face 208. In the illustrated embodiment, rear pin 206 extends into seat aperture 210 to align outlet check valve seat 110 or prime valve seat 128. In alternative embodiments, front pin 204 can instead extend into seat aperture 210, or front pin 204 and rear pin 206 can both extend into seat aperture 210 from opposite sides.

Once outlet check valve seat 110 or prime valve seat 128 is secured between front pin 204 and rear pin 206, mold 202 is assembled about outlet check valve seat 110 or prime valve seat 128. (Step 53). Although mold 202 is schematically depicted with a rectangular cross-section, mold 202 can in fact have a complex shape that defines the exterior contour of outlet check valve seat housing 120 or prime valve seat housing 138. Mold 202 can, for example, be formed of two or more sections that are assembled about outlet check valve seat 110 or prime valve seat 128. Molten or uncured polymer such as acetal or nylon is then injected into mold 202 to form outlet check valve seat housing 120 or prime valve seat housing 138, overmolded about outlet check valve seat 110 or prime valve seat 128. (Step 54). Front pin diameter $D_f$ determines the final front diameter of the fluid passage defined by outlet check valve seat housing 120 or prime valve seat housing 138, while rear pin diameter $D_r$ determines the final rear diameter of the same fluid passage. In the depicted embodiment, $D_f>D_r>D_a>D_s$, such that seat aperture 210 defines the narrowest neck within this fluid passage, and seat housing 120 or 128 is overmolded about seat 120 or 138. $D_f$ is large compared to $D_r$ and $D_a$ so as to provide clearance from outlet check valve sealing elements 108 or prime valve sealing element 126. Once injection-molding is complete, and the polymer of outlet check valve seat housing 120 or prime valve seat housing 138 has cooled, mold 202, front pin 204, and rear pin 206 are withdrawn and the completed workpiece can be removed. (Step 55).

As discussed above with respect to FIG. 2, the overmolded design of outlet check valve seat housing 120 and/or prime valve seat housing 138 allows outlet check valve seat 110 and/or prime valve seat 128 to be precisely aligned, such that outlet check valve assembly 104 and prime valve assembly 28 actuate at precise threshold pressures. As contrasted with prior methods of installing sprayer valve seats via adhesive, sprayer 10 includes seat housings 120 and 138 that surround and retain valve seats 110 and 128, respectively, with high precision and at low cost.

DISCUSSION OF POSSIBLE EMBODIMENTS

The following are non-exclusive descriptions of possible embodiments of the present invention.

A fluid sprayer comprises: a fluid source; a spray tip having a fluid outlet aperture; a pump disposed to pump fluid from the fluid source out the fluid outlet aperture; and an outlet check valve assembly disposed between the pump and the spray tip, the outlet check valve assembly comprising a sealing element, a seat aligned to receive the sealing element, and a polymer housing overmolded about the seat.

The fluid sprayer of the preceding paragraph can optionally include, additionally and/or alternatively, any one or more of the following features, configurations and/or additional components:

A further embodiment of the foregoing fluid sprayer, further comprising a prime valve assembly in fluid communication with the fluid source and the pump.

A further embodiment of the foregoing fluid sprayer, wherein the prime valve assembly comprises a second sealing element, a second seat aligned to receive the second sealing element, and a second polymer housing overmolded about the second seat.

A further embodiment of the foregoing fluid sprayer, wherein the seat is formed of tungsten carbide.

A further embodiment of the foregoing fluid sprayer, wherein the polymer housing is formed of acetal or nylon A further embodiment of the foregoing fluid sprayer, further comprising a rod and a bias element disposed along common axis with the seat and the sealing element.

A further embodiment of the foregoing fluid sprayer, wherein the pump is rated for pressures of at least 360 psi.

A method of forming a check valve assembly for a fluid sprayer, the method comprising: fabricating a valve seat; clamping the valve seat between a front pin with a first diameter, and a rear pin with a second diameter; assembling a mold about the clamped valve seat; injection-molding a seat housing about the clamped valve seat; and removing the clamps and mold from the housing.

The method of the preceding paragraph can optionally include, additionally and/or alternatively, any one or more of the following features, configurations and/or additional components:

A further embodiment of the foregoing method, wherein fabricating the valve seat comprises machining a blank of tungsten carbide to create a seat face matching a sealing element of the check valve assembly, and a seat aperture extending through the valve seat and centered within the seat face.

A further embodiment of the foregoing method, wherein the seat aperture has an aperture diameter less than the first and second diameters.

A further embodiment of the foregoing method, wherein clamping the seat valve comprises inserting a portion of at least one of the front pin and the rear pin into the seat aperture.

A further embodiment of the foregoing method, wherein injection-molding the seat housing comprises injecting molten acetal or nylon into the mold.

A further embodiment of the foregoing method, wherein the first diameter is greater than the second diameter.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid sprayer comprises:

a fluid source;

a spray tip having a fluid outlet aperture;

a pump disposed to pump fluid from the fluid source out the fluid outlet aperture; and an outlet check valve assembly disposed between the pump and the spray tip, the outlet check valve assembly comprising a sealing element, a seat aligned to receive the sealing element, and a polymer housing overmolded about the seat;

wherein the seat is a rigid preformed element having an outer diameter and a first aperture with an aperture diameter, and wherein the overmolding of the polymer housing forms a passage with the first aperture having a front diameter on one side of the seat adjacent the sealing element and a rear diameter on an opposite side of the seat, wherein the front diameter is greater than the aperture diameter and less than the outer diameter of the seat.

2. The fluid sprayer of claim 1, further comprising a prime valve assembly in fluid communication with the fluid source and the pump.

3. The fluid sprayer of claim 2, wherein the prime valve assembly comprises a second sealing element, a second seat aligned to receive the second sealing element, and a second polymer housing overmolded about the second seat.

4. The fluid sprayer of claim 1, wherein the seat is formed of tungsten carbide.

5. The fluid sprayer of claim 1, wherein the polymer housing is formed of acetal or nylon.

6. The fluid sprayer of claim 1, further comprising a rod and a bias element disposed along common axis with the seat and the sealing element.

7. The fluid sprayer of claim 1, wherein the pump is rated for pressures of at least 360 psi.

8. The fluid sprayer of claim 1, wherein the rear diameter is less than the front diameter.

9. A method of forming a check valve assembly for a fluid sprayer, the method comprising:

fabricating a valve seat;

clamping the valve seat between a front pin with a first diameter, and a rear pin with a second diameter;

assembling a mold about the clamped valve seat;

injection-molding a seat housing about the clamped valve seat;

unclamping the valve seat; and removing the mold from the housing.

10. The method of claim 9, wherein fabricating the valve seat comprises machining a blank of tungsten carbide to create a seat face matching a sealing element of the check valve assembly, and a seat aperture extending through the valve seat and centered within the seat face.

11. The method of claim 10, wherein the seat aperture has an aperture diameter less than the first and second diameters.

12. The method of claim 10, wherein clamping the valve seat comprises inserting a portion of at least one of the front pin and the rear pin into the seat aperture.

13. The method of claim 9, wherein injection-molding the seat housing comprises injecting molten acetal or nylon into the mold.

14. The method of claim 9, wherein the first diameter is greater than the second diameter.

15. A fluid sprayer comprises:

a housing;

a fluid source connected to the housing;

a spray tip connected to the housing and having a fluid outlet aperture;

a pump disposed within the housing and configured to pump fluid from the fluid source out the fluid outlet aperture; and a check valve assembly attached to the housing and disposed along the path of the fluid between the fluid source and the spray tip, the check valve assembly comprising a sealing element, a seat aligned to receive the sealing element, and a polymer housing overmolded about the seat;

wherein the seat is a rigid preformed element having an outer diameter and a first aperture with an aperture diameter, and wherein the overmolding of the polymer housing wraps around the seat and forms a passage with the first aperture having a first diameter on one side of the seat and a second diameter on an opposite side of the seat, wherein the first diameter is greater than the aperture diameter and less than the seat outer diameter, and the second diameter is less than the outer diameter of the seat.

16. The fluid sprayer of claim 15, wherein the second diameter is less than the first diameter.

* * * * *